United States Patent [19]

Knobloch et al.

[11] Patent Number: 5,054,694

[45] Date of Patent: Oct. 8, 1991

[54] METHOD AND APPARATUS FOR CRUSHING MATERIAL FOR GRINDING

[75] Inventors: Osbert R. Knobloch, Rheda-Wiedenbruck; Ludger Brentrop, Oelde; Ludger Kimmeyer, Beckum; Manfred Müller, Ennigerloh; Peter Wenningkamp, Gütersloh, all of Fed. Rep. of Germany

[73] Assignee: Krupp Polysius AG, Fed. Rep. of Germany

[21] Appl. No.: 536,295

[22] Filed: Jun. 11, 1990

[30] Foreign Application Priority Data

Jul. 3, 1989 [DE] Fed. Rep. of Germany ..... 3921823

[51] Int. Cl.[5] ..... B02C 4/00

[52] U.S. Cl. ..... 241/24; 241/29; 241/79; 241/80; 241/152 A

[58] Field of Search ..... 241/24, 29, 80, 93, 241/152 A, 79

[56] References Cited

U.S. PATENT DOCUMENTS

| | | | |
|---|---|---|---|
| 4,703,897 | 11/1987 | Beisner et al. | 241/29 X |
| 4,783,012 | 11/1988 | Blasczyk et al. | 241/152 A X |
| 4,840,315 | 6/1989 | Rubin et al. | 241/152 A X |
| 4,889,289 | 12/1989 | Lohnherr et al. | 241/152 A X |

FOREIGN PATENT DOCUMENTS

| | | | |
|---|---|---|---|
| 3334235 | 5/1984 | Fed. Rep. of Germany | 241/29 |

*Primary Examiner*—Mark Rosenbaum

*Attorney, Agent, or Firm*—Learman & McCulloch

[57] ABSTRACT

The invention relates to a method and to apparatus for crushing material for grinding, in which the material for grinding first of all passes in multiple circulation through a grinding stage which operates on the pressure crushing principle and then without further grinding is delivered to a classification stage consisting of two classification assemblies set to different degrees of fineness, the streams of fines from the two classification assemblies being mixed together. By the combination of these two measures a desired flattening of the particle size distribution of the end product is achieved.

18 Claims, 5 Drawing Sheets

METHOD AND APPARATUS FOR CRUSHING MATERIAL FOR GRINDING

FIELD OF THE INVENTION

The invention relates to a method and to apparatus for crushing material for grinding.

BACKGROUND OF THE INVENTION

It is known that cements which are ground in a closed circuit with a material bed roller mill, disagglomerator and classifier or in roller mills do not correspond as regards their quality characteristics to those cements produced in ball mills. The same applies to blast furnace dust as well as to products constituting mixtures of these components. The differences in quality are demonstrated first and foremost in the addition of a higher quantity of water by contrast with ball mill products in order to achieve the standard stiffness of the mortar. This quantity is known from experience to be a measurement of the water requirement of the concrete in order to achieve a specific consistency. An increased water requirement of the concrete corresponds to an increased addition of water for the standard stiffness. Thus in the case of concrete produced with products from material bed roller mills or bowl roller mills it was necessary in the past to set a high water-cement ratio in order to achieve equal workability. The consequence is a higher pore volume and consequently a lower strength.

The said differences in quality are for the most part based in the narrower particle spectrum which products from material bed roller mills or bowl roller mills have in contrast to ball mill products. In the known grinding apparatus with material bed roller mills or bowl roller mills the classification stage usually occurs immediately after the material for grinding has passed once through the mill. This fulfils in an ideal manner the requirement of the size reduction theory that in the interest of optimum utilisation of energy the fines produced should be removed from circulation as quickly as possible. Accordingly, in the case of grinding apparatus in this category much less fine material is contained in the material for grinding which is delivered to the classifier than is the case in ball mill apparatus.

The particle spectrum of cement and cement-like products is usually represented as a sum distribution in the "RRSB grid" developed by Rosin, Rammler et al. The axis scales of this grid are chosen so that the sum distributions or normal mineral crushing products appear as straight lines. These sum distributions are described by two parameters:

the particle size d' for a specific screen residue (36.8%)

and the inclination n which corresponds to the tangent of the angle between the particle size line and the abscissa.

The basis for this method of representation is the empirical fact that the particle size distributions of very many mineral crushing products have a similar structure irrespective of their fineness.

The usual measure for the fineness of cement, blast furnace dust and similar products is the specific surface area or Blaine fineness. The higher this fineness is, the higher the strengths are of the mortars and concretes produced therefrom. The specific surface area is inversely proportional to the mean particle size (in the case of the same specific surface area the strength defined in the relevant standards is higher the narrower the product particle spectrum is).

The fewer fines are contained in the feed material for the classifier, the finer their separation limit must be set (see below) so that the product has the desired specific surface area. In order to compensate for the lack of fines a corresponding proportion of tailings must be separated off. Thus the product particle spectrum is narrowed from both sides. As a result the porosity of the product increases, and with the porosity the water requirement in order to achieve a specific mortar or concrete consistency also increases.

The connection explained above has been observed with the introduction of selective separators in ball mills and has led in some cases to the rejection of products.

The object of the invention, therefore, is to provide a method and apparatus for crushing material for grinding in such a way that the particle size distribution of the finished product can be set accurately over a sufficiently large range (and indeed—expressed as an alteration in the inclination n in the RRSB grid—by at least 0.2) in order to adapt the products of such energy-saving grinding apparatus to the standard of the products produced in the ball mill apparatus as regards their particle size distribution and thus also as regards the way they behave during processing and their strength development, and also in order to compensate for chemically induced (for example by the raw material) shortcomings by advantageous adjustment of the particle size distribution of the finished product.

SUMMARY OF THE INVENTION

This object is achieved for example by passing the material through a grinding device operating on the pressure crushing principle, including returning a proportion of the throughput of the grinding device thereto for another pass through the grinding device, distributing the remainder of the throughput of the grinding device to multiple (e.g., two) classification assemblies set to different degrees of fineness, and mixing the fines from the two classification assemblies. Advantageous embodiments of the invention are the subject matter of the subordinate claims.

Thus the solution according to the invention resides basically in the combination of two method steps which both effect a broadening of the particle spectrum of the fines:

By returning a high proportion of the material for grinding immediately after it has passed through the grinding stage, the mean residence time of the material for grinding in the mill which operates according to the pressure crushing principle or the frequency of stressing is increased and a higher proportion of fines is achieved in the feed material for the classification stage, which results in a broadening of the particle spectrum of the feed material for the classification stage.

By separating the remaining material for grinding in two classification assemblies which are arranged practically parallel, are set to different degrees of fineness and offer high quality separation and by mixing the two streams of fines, an additional flattening is produced in the upper range in the particle size line of the product.

These two measures according to the invention and the effects achieved thereby will be considered below in somewhat greater detail.

If a large proportion of the material for grinding in the mill which is constructed as a material bed roller mill is returned directly to the feed shaft of this mill (so-called scab return), then the higher mean residence time or greater frequency of stressing of the material for grinding in the mill results in a higher proportion of fines in the feed material for the classification stage. The same also applies fairly reasonably if a bowl roller mill is used as the mill in the grinding stage. In order to achieve the same specific surface area of the finished product, the separation limit of the classification must be shifted towards the coarse end, which flattens the particle size line of the finished product particularly in the range below 10 μm (compared with operation without the return of scabs or material for grinding).

Since the condition for optimum utilisation of energy which is referred to in the introduction (quickest possible removal from circulation of the fines produced) is no longer fully met, the return of the scabs or material for grinding in fact increases the energy consumption for grinding, but nevertheless this method still offers advantages in terms of energy by comparison with the combined operation with roller mill and ball mill.

According to the invention at least 50%, but preferably 70 to 75% of the throughput quantity of the grinding stage is immediately returned to this grinding stage (that is to say for example the material bed roller mill) immediately after passing through the grinding stage. Thus the greater part of the circulation is transferred to the material bed roller mill. In this way the residence time in the grinding region, which is proportional to the circulation in the region of the grinding zone, is multiplied (for example, if 80% of the scabs are returned to the material bed roller mill, then on average the material for grinding passes through the material bed roller mill five times). The same also applies as appropriate when a bowl roller mill is used.

The following relationships are essential for an understanding of the second measure according to the invention (separation of the material for grinding in two classification assemblies which are set to differing degrees of fineness):

In the industrial separation (classification or sifting) of bulk materials the division between "fine" and "coarse", the so-called separation limit, is not perfect but extends over a certain range of the particle spectrum. The separation limit "d(50)" defines the particle size at which 50% of the feed material passes into the fines and 50% into the tailings. Apart from that it is common for a proportion of the feed material to pass unclassified into the tailings. For this reason in the case of industrial separations certain quality features must also be set out.

The overall quality of separation is characterised by the selectivity and the effectiveness of separation.

The selectively states something about the breadth of the range in the particle spectrum in which material can pass both into the fines and into the tailings. The narrower this range is, the higher the selectively is. It is quantified by the ratio of the particle sizes at which 30% or 70% of the feed material passes into the tailings ("$K_{30/70}$").

The effectiveness of separation relates to the proportion of the feed material which is actually classified or the proportion which passes unclassified into the tailings. The higher the latter is, the lower the effectiveness of separation is and the more fines remain in the tailings. The characteristic quantity for the unclassified proportion is "$\tau$".

In the investigations on which the invention is based it has been found that by reducing the selectivity and maintaining a constant high effectiveness of separation ($\tau=0$) the particle spectrum of the fines can be markedly broadened, predominantly in the range of the coarser portions.

This can not be achieved to a sufficient extent in a classification assembly because for this purpose the classification conditions would have to be variable in the entire classification zone. Therefore according to the invention two classification assemblies are used in which different separation limits are set, advantageously in the ratio 1:1.5 to 1:4. The resulting separation characteristic has a low selectivity. In this way the particle size line of the product undergoes an additional flattening in the range above 10 μm (compared with operation with only one classification assembly).

The combined use of the two features according to the invention effects a reduction of the inclination n of the particle size distribution of the product in the RRSB grid by more than 0.2 (from 1.2 to 0.95), which is explained below with the aid of an example.

According to the invention the specific surface area (Blaine fineness) of the rest of the throughput quantity which is drawn off from the grinding stage and delivered to the classification stage amounts advantageously to 0.5 to 0.8 times the specific surface area of the finished product (by contrast, in conventional operation without the return of scabs this range is 0.2 to 0.4 times).

In the classification stage the specific surface area (Blaine fineness) of the fines from one classification assembly (which supplies the finer components) advantageously amounts to 1.2 to 2.0 times the specific surface area of the finished product, whilst the other classification assembly (which produces the coarser components) supplies a fine material the specific surface area of which amounts to 0.4 to 0.8 times the specific surface area of the finished product.

As a supplement to the measures described, it is possible to regrind at least one branch stream of the fines from the classification stage in a ball mill.

In addition to refining this effects a further broadening of the particle size distribution of the product. There is also the possibility of mixing two branch streams of fines.

DESCRIPTION OF THE DRAWINGS

The invention is illustrated by way of example in the drawings, in which.

DETAILED DESCRIPTION OF THE INVENTION

Figure 1:
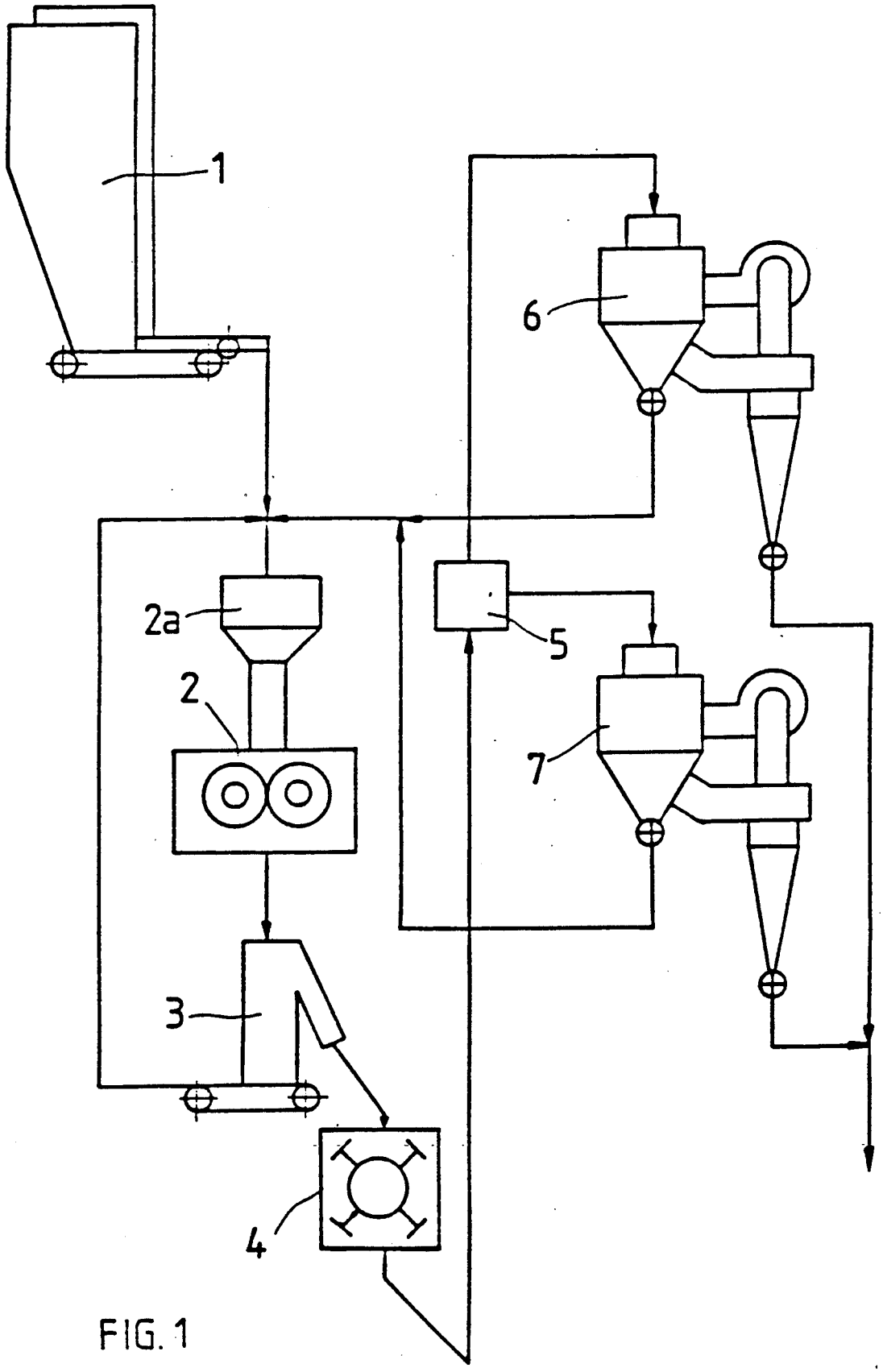
FIG. 1 shows a schematic diagram of apparatus according to the invention with a grinding stage formed by a material bed roller mill.

The apparatus shown in FIG. 1 for crushing material for grinding, particularly cement clinker, contains a feed bin 1 provided with dispensing devices, a material bed roller mill 2, a first material stream divider 3 provided with a dispensing device, a disagglomerator 4, a second material stream divider 5 as well as two classification assemblies 6 and 7. By means of the first material stream divider 3 arranged after the material bed roller mill 2 an adjustable proportion of the throughput quantity of the material bed roller mill 2 is returned directly to the feed shaft 2*a* of the material bed roller mill 2, so that the material for grinding passes several times through the material bed roller mill, the average residence time of the material for grinding in the mill is increased and accordingly a higher proportion of fines is produced in the material discharged from the material bed roller mill.

The rest of the throughput quantity which is not returned to the material bed roller mill passes via the disagglomerator 4 to the second material stream divider 5 which divides the total stream of material delivered to the classification stage and distributes it to the two classification assemblies 6 and 7. The tailings precipitated in the classification assemblies 6 and 7 are passed to the feed shaft 2*a* of the material bed roller mill 2 together with the fresh material for grinding delivered from the feed bunker as well as the proportion of scabs returned from the first material stream divider 3.

The streams of fines from the two classification assemblies 6 and 7 which are set to different degrees of fineness are mixed together and form the finished product which is distinguished by a flat particle size distribution.

Figure 2:
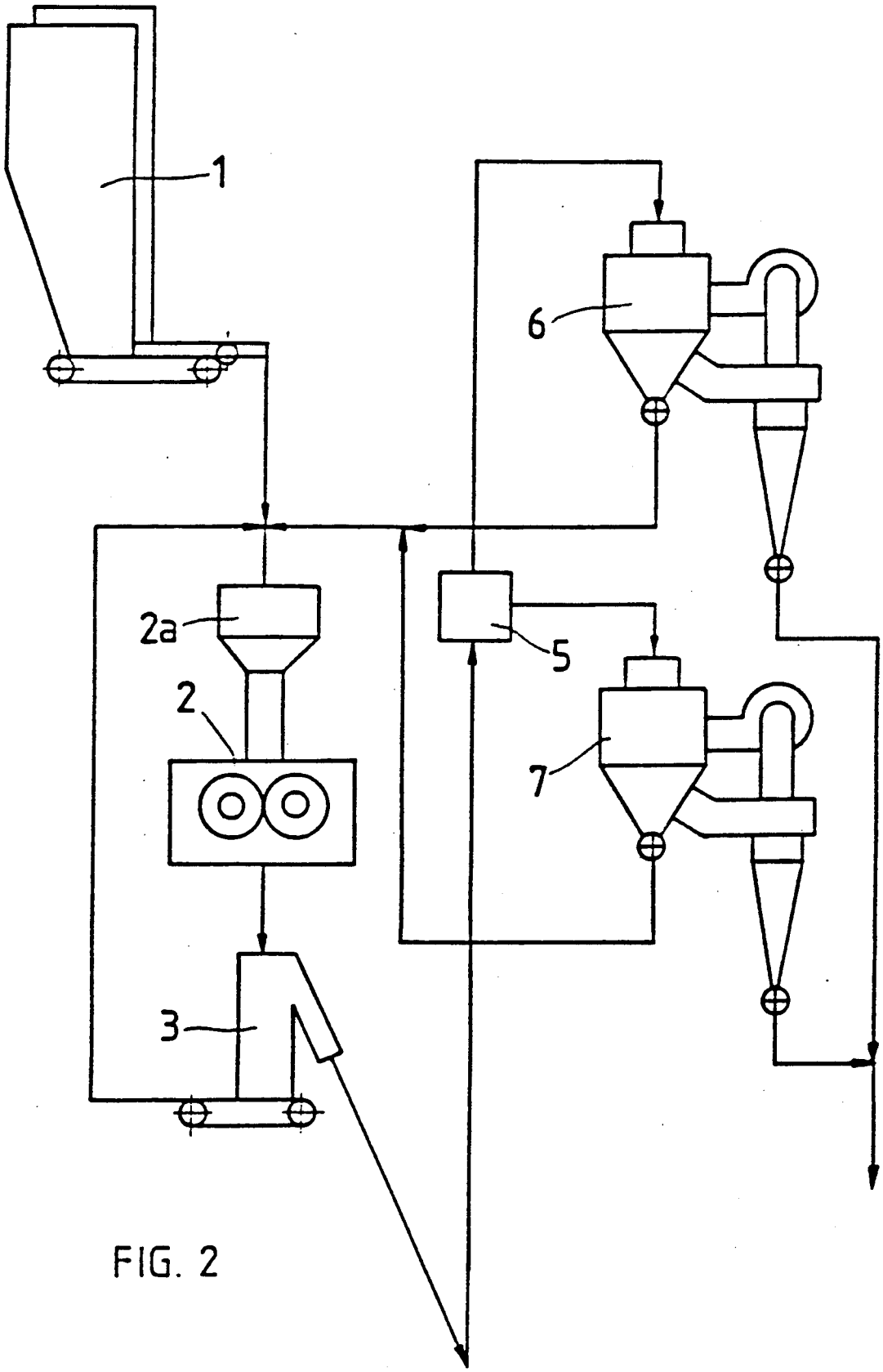
FIGS. 2 and 3 show variants of the apparatus according to FIG. 1.

The embodiment according to FIG. 2 differs from the apparatus according to FIG. 1 only in the omission of the disagglomerator 4.

Figure 3:
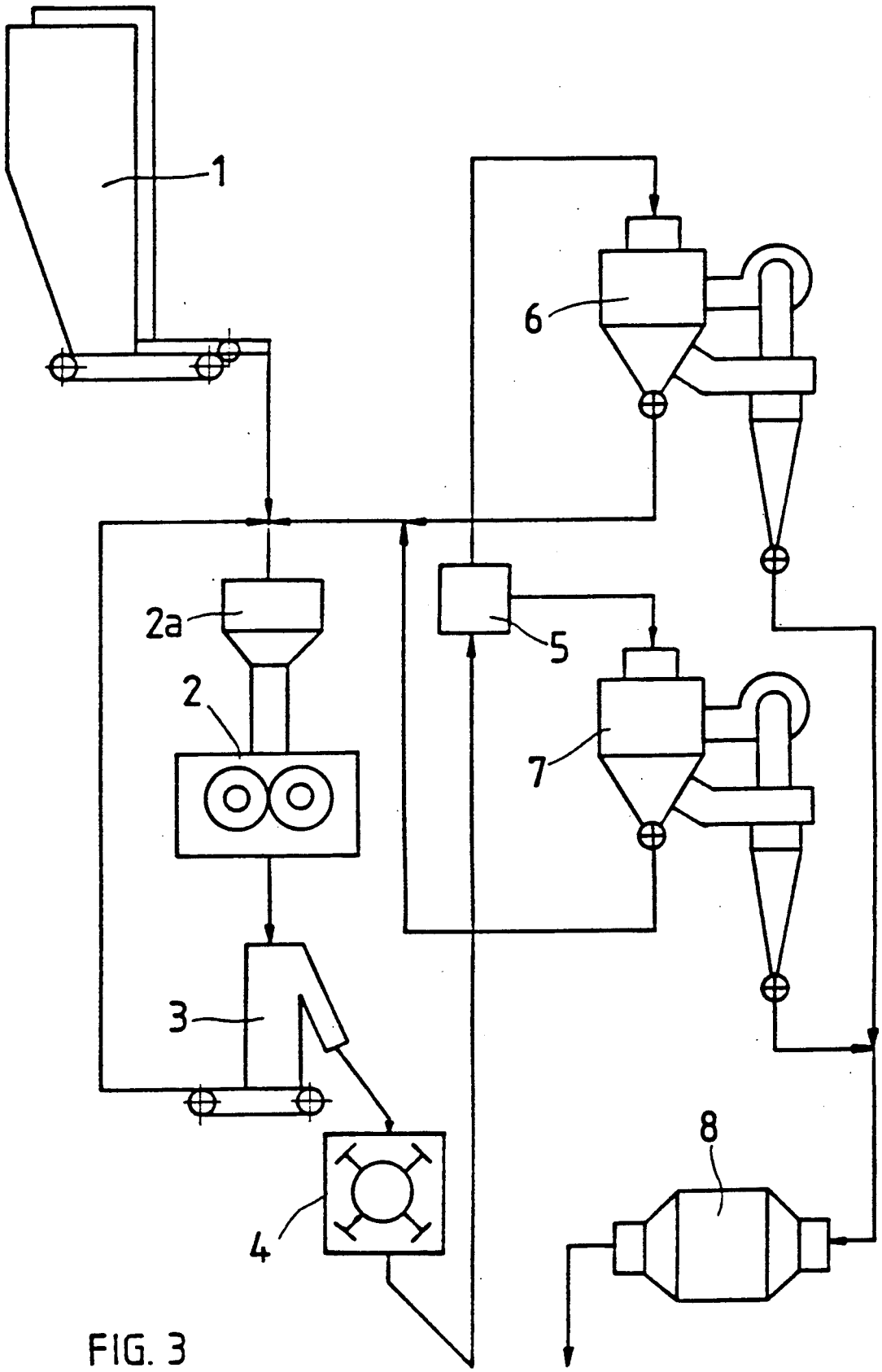

In the variant shown in FIG. 3, in addition to the apparatus parts shown in FIG. 1 a ball mill 8 is also provided which serves for regrinding of at least a proportion of the fines from the classification stage formed by the classification assemblies 6 and 7.

Figure 4:
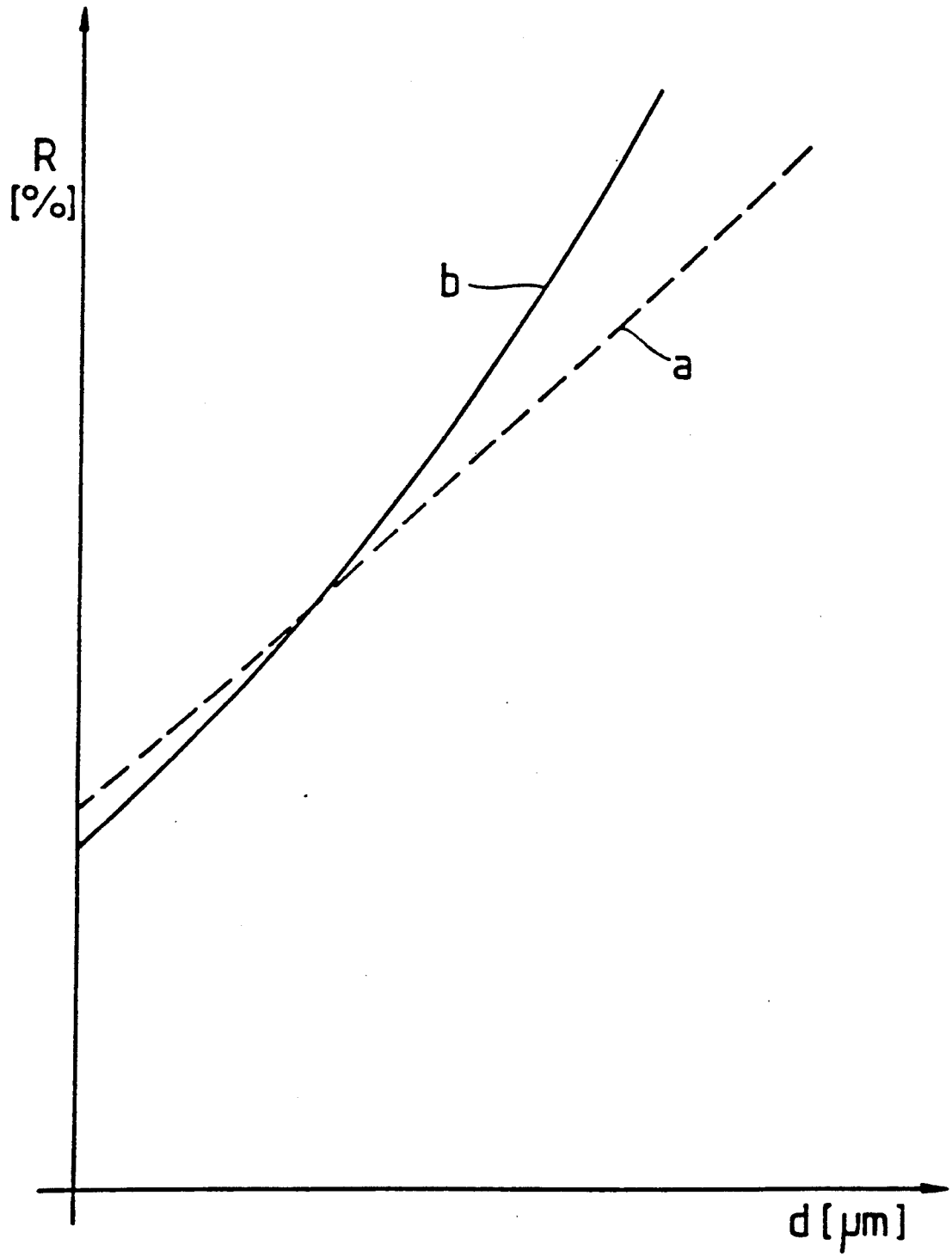
FIG. 4 shows a diagram to explain the effect achieved by the measures according to the invention.

FIG. 4 shows in schematic representation, but relying on the RRSB grid, the product particle size distribution (curve a) which can be achieved with the method according to the invention in comparison with the conventional manner of operation (curve b) in which the scabs are not returned nor is there any mixing of two streams of fines of differing degrees of fineness.

In the abscissa of the diagram the particle size d is shown in μm and in the ordinate the screen residue R is shown in %.

Figure 5:
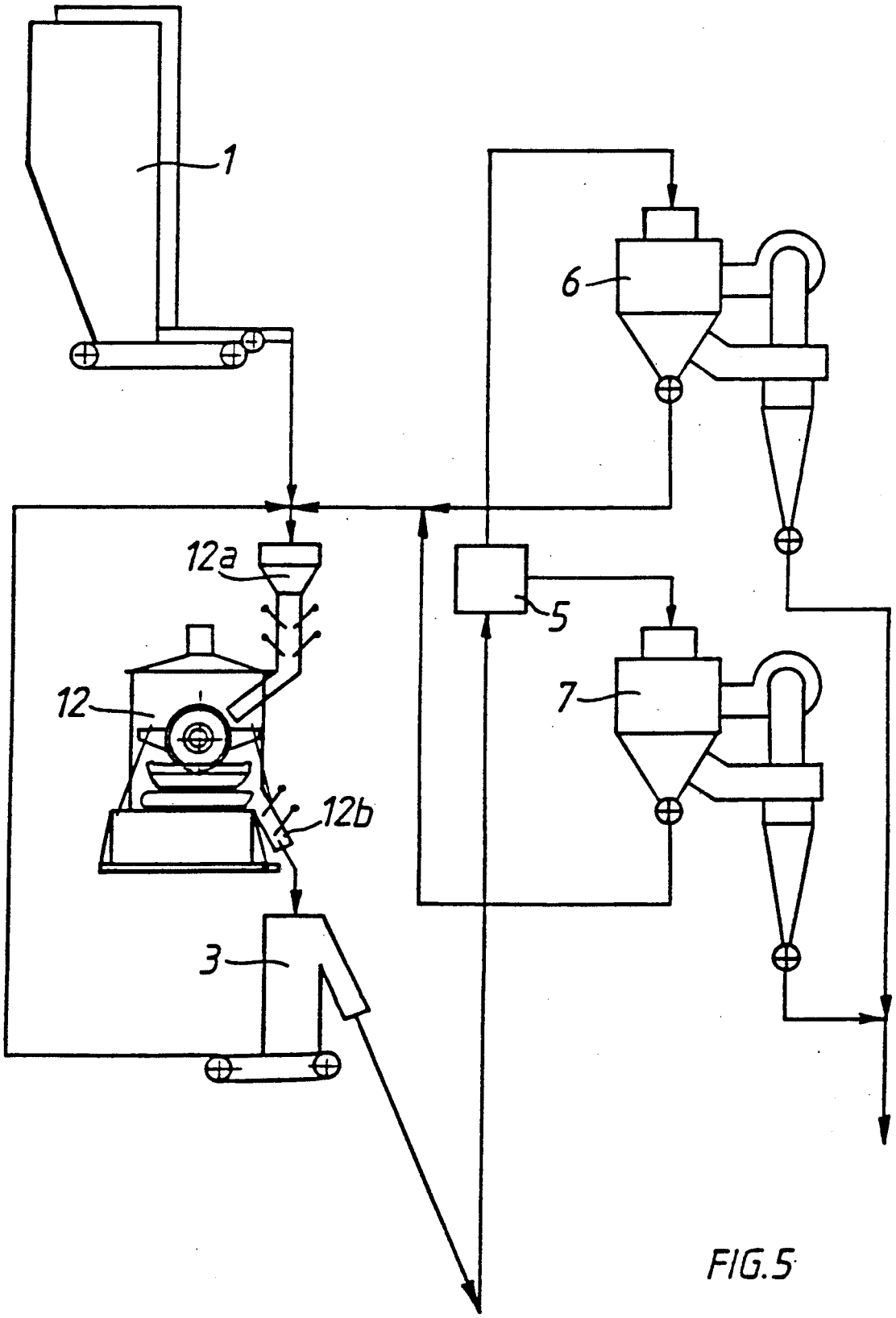
FIG. 5 shows a similar schematic diagram to that of FIG. 2 with an example in which the grinding stage is formed by a bowl roller mill.

Whereas in the examples of the invention described above the grinding stage for the multiple circulation of the material for grinding is formed by at least one material bed roller mill 2 which is particularly preferred because of its crushing work, in many cases a bowl roller mill can also be used for this grinding stage, as is shown with the aid of the schematic diagram according to FIG. 5. In the case of a bowl roller mill, too, the material for grinding which passes several times through the grinding stage is crushed using the pressure crushing principle.

As has been mentioned above, the apparatus according to the example illustrated in FIG. 5 is of substantially similar construction to the apparatus according to FIG. 2, but with the difference that here a bowl roller mill 12 forms the grinding stage instead of the material bed roller mill 2. This bowl roller mill 12 is preferably a bowl roller mill which has no separator and to which material to be crushed is delivered in a manner which is known per se via an appertaining feed shaft 12*a* and from which the crushed material—also in a manner which is known per se—falls downwards through a material outlet 12*b* and is drawn off and again returned to the first material stream divider 3.

In this example of the apparatus according to FIG. 5 the rest of the course of the method is—as already mentioned—otherwise similar to that of FIG. 2, so the remaining parts of the apparatus are again given the same reference numerals as in the example according to FIGS. 1 to 3—with the exception of a disagglomerator 4 which is dispensable here. Here too the second material stream divider 5 ensures that the material branch stream to be delivered to the classification stage is divided and distributed in the necessary manner to the two classification assemblies 6 and 7 which in this case ensure a more reliable separation or classification than is generally the case with bowl roller mills with a separator built above.

The invention will now be explained with the aid of an

EXAMPLE which relates to the grinding of granulated blast furnace slag in a semi-industrial grinding apparatus with a material bed roller mill and high-capacity separators. The following modes of operation are constrasted:

(a) conventional grinding without scabs being returned and using one single separator.

(b) grinding with scabs being returned and using one single separator, (c) grinding with scabs being returned and additional classification in two classifiers set to different degrees of fineness and with the streams of fines being mixed.

In each case below the fineness (i.e. the specific surface area) of the individual streams of material are given (in $cm^2/g$) as well as the ratios of quantities, with the throughout of the apparatus (=fresh material=finished product) set to be equal to 1.0. Also given are the recycle factors and characteristic values of the classification and the particle size distribution of the product.

With regard to (a):

| | | |
|---|---|---|
| fresh material | <100 $cm^2/g$ | 1.00 |
| material for grinding after roller mill (to class.) | 1330 $cm^2/g$ | 6.00 |
| classifier tailings (to feed shaft) | 830 $cm^2/g$ | 5.00 |
| finished product | 4170 $cm^2/g$ | 1.00 |

The recycle factor is 6.0;
the separation limit $d_{50}$ of classification is 13.5 μm;
the selectivity $K_{30/70}$ is 0.64;
the inclination n of the particle size distribution of the product is 1.20;
the position parameter d' is 12 μm.

With regard to (b):

| | | |
|---|---|---|
| fresh material | <100 $cm^2/g$ | 1.00 |
| material for grinding after roller mill | 2290 $cm^2/g$ | 7.50 |
| proportion to feed shaft (scab ret.) | 2290 $cm^2/g$ | 5.50 |
| proportion to classifier | 2290 $cm^2/g$ | 2.00 |
| classifier tailings | 600 $cm^2/g$ | 1.00 |
| total returned material to feed shaft | — | 6.50 |
| finished product | 4100 $cm^2/g$ | 1.00 |

The total recycle factor is 7.5;
the proportion of scab return is 73%
the classifier recycle factor is 2.0;
the separation limit $d_{50}$ of classification is 33 μm;
the selectivity $K_{30/70}$ is 0.65;

the inclination n of the particle size distribution of the product is 1.00;

the position parameter d' is 15 μm.

With regard to (c):

| | | |
|---|---|---|
| proportion to classification stage | 2290 $cm^2/g$ | 2.00 |
| proportion to coarse set classifier | — | 1.05 |
| proportion to fine set classifier | — | 0.95 |
| tailings from coarse set class. | — | 0.40 |
| tailings from fine set class. | — | 0.60 |
| total classifier tailings | 660 $cm^2/g$ | 1.00 |
| total return material to feed shaft | — | 6.50 |
| fines from coarse set classifier | 3050 $cm^2/g$ | 0.65 |
| fines from fine set classifier | 6010 $cm^2/g$ | 0.35 |
| total finished product | 4100 $cm^2/g$ | 1.00 |

The recycle factor at the coarse set classifier is 1.6;

the recycle factor at the fine set classifier is 2.7;

the total classifier recycle factor is 2.0;

the separation limit $d_{50}$ of the coarse partial classification is 74 μm;

the selectivity $K_{30/70}$ of the coarse partial classification is 0.63;

the separation limit $d_{50}$ of the fine partial classification is 18 μm the selectivity $K_{30/70}$ of the fine partial classification is 0.63;

the separation limit $d_{50}$ of the total classification is 42 μm the selectivity $K_{30/70}$ of the total classification is 0.37;

the inclination n of the particle size distribution of the product is 0.92;

the position parameter d' is 17.5 μm.

We claim:

1. Method of crushing material for subsequent grinding comprising the steps of:

(a) passing the material through a grinding device operating on the pressure crushing principle, including returning a proportion of the throughout of the grinding device thereto for another pass through said grinding device, (b) distributing the remainder of the throughput of the grinding device to multiple classification assemblies set to different degrees of fineness, and (c) mixing the fines from the classification assemblies.

2. Method as claimed in claim 1, characterized in that in step (a) the material is passed through a material bed roller mill.

3. Method as claimed in claim 2 characterised by the further step of disagglomerating said remainder of the throughput of the grinding device stage before it is distributed to the classification assemblies.

4. Method as claimed in claim 1, characterised in that in step (a) the material is passed through a bowl roller mill.

5. Method as claimed in claim 4 characterized in that the bowl roller mill operates with an external classifier.

6. Method as claimed in claim 1, characterised in that at least 50% of the throughput of the grinding device is delivered back to the grinding device immediately after passing through the grinding device.

7. Method as claimed in claim 1, characterised in that 70 to 95% of the throughput of the grinding device is delivered back to the grinding device immediately after passing through the grinding device.

8. Method as claimed in claim 1, characterised in that the specific surface area of the rest of the throughput quantity drawn off from the grinding device and delivered to the classification assemblies is 0.5 to 0.8 times the specific surface area of the finished product.

9. Method as claimed in claim 1, characterised in that the specific surface area of the fines from one classification assembly is 1.2 to 2.0 times and that of the other classification assembly is 0.4 to 0.8 times the specific surface area of the finished product.

10. Method as claimed in claim 1, characterised in that the two classification assemblies are provided with separate limits set in a ratio of 1:1.5 to 1:4.

11. Method as claimed in claim 10 characterized in that the proportion of the stream of fines is subjected to regrinding in a ball mill.

12. Method as claimed in claim 1, characterised in that at least a proportion of the stream of the fines from the classification assemblies is subjected to regrinding.

13. Apparatus for crushing material for subsequent grinding comprising:

(a) a mill operating on the pressure crushing principle and having a feed shaft, (b) a first material stream divider which is arranged after the mill and through which an adjustable proportion of the throughput quantity of the mill can be returned to the feed shaft of the mill and through which the remainder of the throughput quantity can be delivered for classification, (c) two classification assemblies for receiving said remainder of the throughput quantity of the mill, said classification assemblies being set to different degrees of fineness, and (d) a second material stream divider between the first material stream divider and the classification assemblies for distributing said remainder of the throughput quantity to the two classification assemblies.

14. Apparatus as claimed in claim 13, characterised in that the mill operating on the pressure crushing principle comprises a material bed roller mill (2).

15. Apparatus as claimed in claim 14, characterised in that a disagglomerator (4) is arranged between the two material stream dividers (3, 5).

16. Apparatus as claimed in claim 13, characterised in that the mill operating on the pressure crushing principle comprises a bowl roller mill (12).

17. Apparatus as claimed in claim 13, characterised in that a further mill is arranged after the classification assemblies and serves for regrinding at least a proportion of the fines from the classification assemblies.

18. Apparatus as claimed in claim 17 characterized in that the further mill comprises a ball mill.

* * * * *

UNITED STATES PATENT AND TRADEMARK OFFICE

CERTIFICATE OF CORRECTION

PATENT NO. : 5,054,694

DATED : October 8, 1991

INVENTOR(S) : Osbert R. Knobloch, Ludger Brentrop, Ludger Kimmeyer, Manfred Muller, and Peter Wenningkamp It is certified that error appears in the above-identified patent and that said Letters Patent is hereby corrected as shown below:

Column 3, lines 55 and 58, change "selectively" to -- selectivity --.

Column 6, line 25, change "constrasted" to -- contrasted --; line 36, change "throughout" to -- throughput --.

Column 7, line 39, change "throughout" to -- throughput --.

Column 8, line 19, change "separate" to -- separation --.

Signed and Sealed this

Ninth Day of March, 1993

*Attest:*

STEPHEN G. KUNIN

*Attesting Officer*

*Acting Commissioner of Patents and Trademarks*